United States Patent [19]

Barker

[11] Patent Number: 4,934,251

[45] Date of Patent: Jun. 19, 1990

[54] HYDRAULIC MOTOR OR PUMP WITH CONSTANT CLAMPING FORCE BETWEEN ROTOR AND PORT PLATE

[75] Inventor: Brian P. Barker, Ventura, Calif.

[73] Assignee: Allied-Signal Inc., Morris Township, Morris County, N.J.

[21] Appl. No.: 285,849

[22] Filed: Dec. 16, 1988

[51] Int. Cl.[5] ..... F01B 13/04

[52] U.S. Cl. ..... 91/486; 91/499

[58] Field of Search ..... 91/6.5, 484, 485, 486, 91/487, 489, 499, 505, 506

[56] References Cited

U.S. PATENT DOCUMENTS

| | | | |
|---|---|---|---|
| 2,288,768 | 7/1942 | Zimmermann | 91/6.5 |
| 3,037,489 | 6/1962 | Douglas . | |
| 3,199,461 | 8/1965 | Wolf | 91/6.5 |
| 3,858,483 | 1/1975 | Hein | 91/6.5 |
| 3,999,466 | 12/1976 | Aschke | 91/499 |
| 4,007,663 | 2/1977 | Nagatomo et al. | 91/499 X |
| 4,540,345 | 9/1985 | Frazer | 91/6.5 X |
| 4,757,743 | 7/1988 | Tovey | 91/6.5 |

FOREIGN PATENT DOCUMENTS

| | | | |
|---|---|---|---|
| 684551 | 12/1952 | United Kingdom | 91/499 |
| 1143681 | 2/1969 | United Kingdom | 91/499 |

*Primary Examiner*—Leonard E. Smith

*Attorney, Agent, or Firm*—Joseph R. Black; James W. McFarland; Robert A. Walsh

[57] ABSTRACT

A hydraulic axial piston motor or pump (8) of the type in which a rotor (10) has an odd-numbered plurality of cylinder ports (30) with which the arcuate ports (40,42) of a port plate (36) successively register. The port plate (36) is provided with fluid exchange ports (44,46) through which cylinders (16) communicate with a hydraulic capacitance system (81,82,84,86,93). The capacitance system (81,82,84,86,93) urges fluid into each cylinder (16) of the rotor (10) through an exchange port (44) after the associated cylinder port (30) has departed from registration with one arcuate port (40) but before the associated piston (14) has reached its bottom-dead-center position (72), and receives fluid from each cylinder through an exchange port (46) after the associated piston has begun its compression stroke but before the cylinder port has begun to register with a second arcuate port (42). Urging fluid into each cylinder eliminates cavitation effects that would otherwise result from having too large a decompression zone (68–67), while receiving fluid from each cylinder prevents excessive pressurization that would otherwise result from having too large a precompression zone (67). The invention thus enables the use of arcuate ports (40,42) which subtend the more limited angular ranges required to provide a pump or motor that operates with a constant number of high-pressure cylinders and, consequently, with a constant clamping force between the rotor (10) and the port plate (36).

29 Claims, 4 Drawing Sheets

HYDRAULIC MOTOR OR PUMP WITH CONSTANT CLAMPING FORCE BETWEEN ROTOR AND PORT PLATE

TECHNICAL FIELD

This invention relates generally to hydraulic motors or pumps and more particularly to those which employ a flat valve or port plate in conjunction with a rotatable member (hereinafter "rotor") which defines a plurality of cylinders in which a corresponding plurality of pistons reciprocate as the rotor rotates about its longitudinal axis. Typically, the port plate has two arcuate ports with which a plurality of cylinder ports of the rotor successively register. As this registration occurs, either high-pressure or lowpressure fluid (depending on whether the apparatus is used as a motor or pump) is received through one of the arcuate ports into the cylinders, and either low-pressure or high-pressure fluid is returned from the cylinders through the other arcuate port.

BACKGROUND OF THE INVENTION

A problem with pumps and motors of the above description is that there is a conflict between the need to prevent cavitation and excessive pressurization of cylinder walls in the rotor and the desire to provide a constant clamping force between the rotor and port plate. Cavitation results from implosions of gases entrained in the fluid which is in the cylinders. These implosions occur as a consequence of decompression of a cylinder after it has departed from registration with an arcuate port of the port plate (the lowpressure port in the case of a pump or the high-pressure port in the case of a motor). The greater the arc over which the cylinder travels under this condition, the greater is the possibility of cavitation. Excessive pressurization occurs when the cylinder travels over too large a precompression zone before fluid is released from the cylinder. The cavitation and/or excessive pressurization problems may be solved by extending the angles subtended by the arcuate ports so that the foresaid arc is sufficiently small. A known approach toward solving the excessive pressurization problem is to provide in the port plate a hole through which fluid is transferred to the high-pressure arcuate port when the pressure in the cylinder reaches the pressure in the high-pressure port (see, e.g. U.S. Pat. No. 4,540,345 Frazer). However, when design considerations dictate the use of a rotor having an odd number of cylinders (which is ordinarily the case), these solutions restrict the practicable geometry between the ports of the rotor and port plate such that the pump or motor must be designed to operate with a fluctuating number of high-pressure cylinders if both cavitation and excessive pressurization are to be prevented. Fluctuation in the number of high-pressure cylinders is accompanied by fluctuation in forward thrust load on the rotor, and by fluctuation in clamping force between the rotor and the port plate. Fluctuation in clamping force can be expected to result in uneven wearing of the interfacing surfaces of the rotor and the port plate, and in metering inefficiency resulting from leakage to case pressure (which in turn may impose practical limitations on operating speed). Fluctuation in thrust load on the rotor can be expected to result in accelerated or less uniform wearing of piston shoes and thrust bearings. Past attempts at alleviating these effects have focused on the use of timing ports in fluid communication with auxiliary hold-up pistons which provide supplemental clamping force when there is a higher number of high-pressure cylinders (see, e.g. U.S. Pat. No. 3,037,489 Douglas). That approach, which is compensatory rather than remedial in nature, provides only a partial solution and creates the further problem of increased noise resulting from periodic occlusion of fluid communication to the auxiliary hold-up pistons.

Accordingly, an objective of this invention is to provide hydraulic motors and pumps which reduce or prevent cavitation and excessive pressurization while simultaneously providing a constant or substantially constant clamping force between rotor and port plate.

Another objective of this invention is to provide such motors or pumps that do not require the use of auxiliary hold-up pistons.

A further objective of this invention is to provide such motors and pumps that can be operated at higher speeds.

A still further objective of this invention is to provide such motors or pumps that operate with a substantially constant thrust load on the rotor.

These and further objectives and advantages of the invention will be apparent from the following description which includes the appended claims and accompanying drawings.

SUMMARY OF THE INVENTION

This invention is designed to provide hydraulic piston motors and pumps that operate with a substantially constant clamping force between the rotor and the port plate while preventing cavitation and excessive pressurization of cylinder walls.

According to the invention, fluid communication between an odd-numbered plurality of uniformly spaced cylinder ports of the rotor and the two arcuate ports of the port plate is provided such that as each cylinder port begins to register with one of the arcuate ports, another cylinder port begins to register with the other arcuate port. Consequently, although the distribution of the clamping force will vary over a limited range, the magnitude of the force should remain substantially constant. To prevent cavitation that would otherwise occur, the invention incorporates means for urging fluid into each cylinder during that portion of the decompression stroke of its associated piston in which the cylinder port has departed from registration with a lowpressure arcuate port (in the case of a pump) or a highpressure arcuate port (in the case of a motor). The added fluid reduces depressurization in the cylinder in order to prevent cavitation effects. The volume of fluid urged into each cylinder during the decompression stroke of its associated piston is subsequently discharged from the cylinder at a very early stage of the compression stroke of its associated piston.

DESCRIPTION OF THE PREFERRED EMBODIMENT

Figure 1:
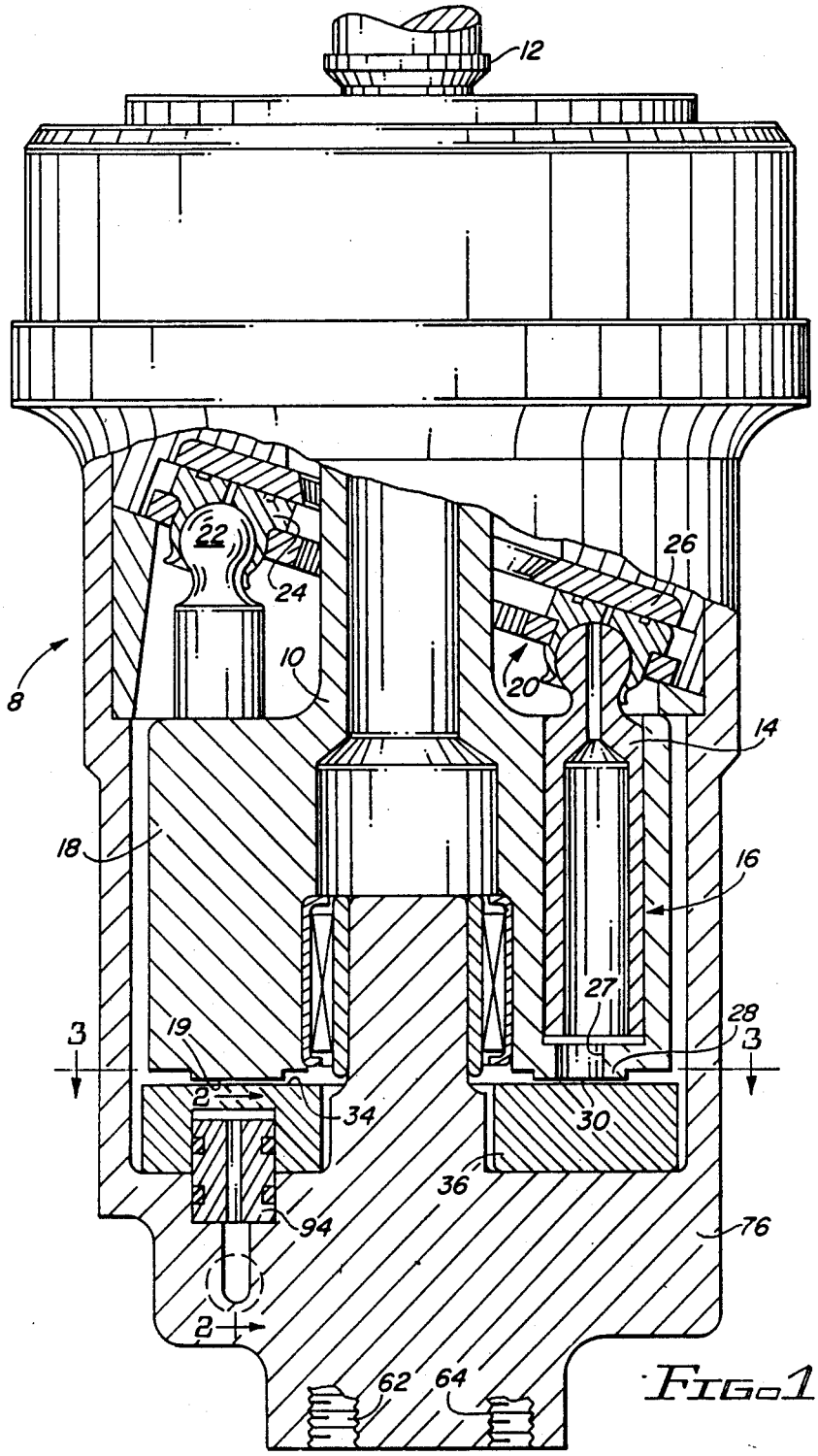
FIG. 1 illustrates a hydraulic pump or motor in partial cross-section.

Those skilled in the art to which the present invention relates will recognize that the apparatus 8 illustrated in FIG. 1 can be operated as either a pump or a motor. In order to spare the reader from repeated reminders of that duality of application, and without intention to restrict the invention by the manner in which it is applied, the apparatus 8 will be described in accordance with its operation as a pump.

In FIG. 1, the pump 8 is a hydraulic axial piston pump in which a generally cylindrical rotor 10 drivingly engaged with a shaft 12 is rotated to cause pistons (as at 14) to reciprocate within cylinders (as at 16) formed in a cylinder barrel portion 18 of the rotor. The reciprocating motion of the pistons 14 is effected by a cam arrangement 20 in which ball-shaped ends 22 of the pistons are fitted in shoes 24 which bear against a swashplate 26. The barrel portion 18 defines nine axially extending cylinders 16 of uniform circumferential spacing and nine associated counterbores 27. A ring-shaped extension 28 of the rotor 10 defines an annular land 19. The counterbores 27 extend from the land 19 to the cylinders 16. Accordingly, the rotor 10 defines nine uniformly spaced cylinder ports (as at 30), each being associated with a particular piston and cylinder and being in fluid communication therewith. The land 19 is in facing relationship with a first surface 34 of a port plate 36.

Figure 2:
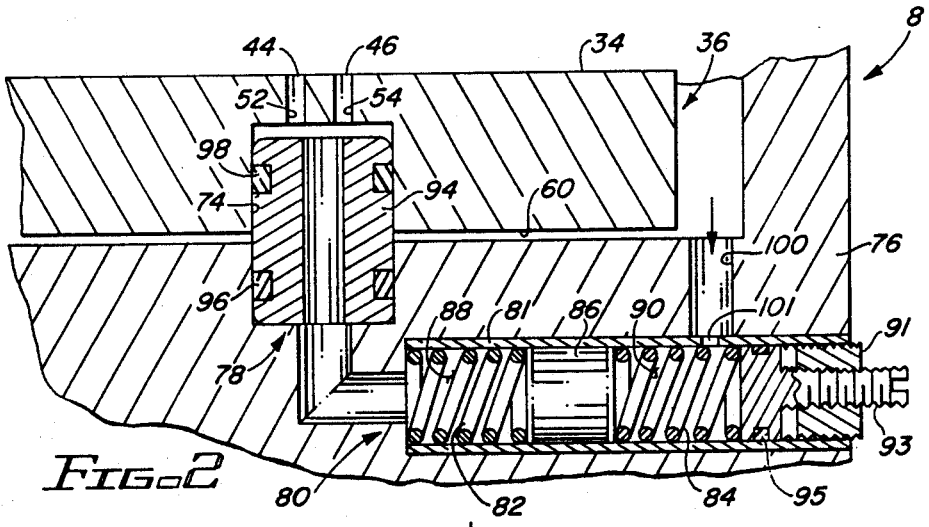
FIG. 2 is taken along line 2—2 of FIG. 1 and is a partial cross-sectional view of the port plate and encasement indicated therein. This drawing illustrates means for adding fluid to each cylinder during the decompression stroke of its associated piston in accordance with the preferred embodiment of the invention.
Figure 5:
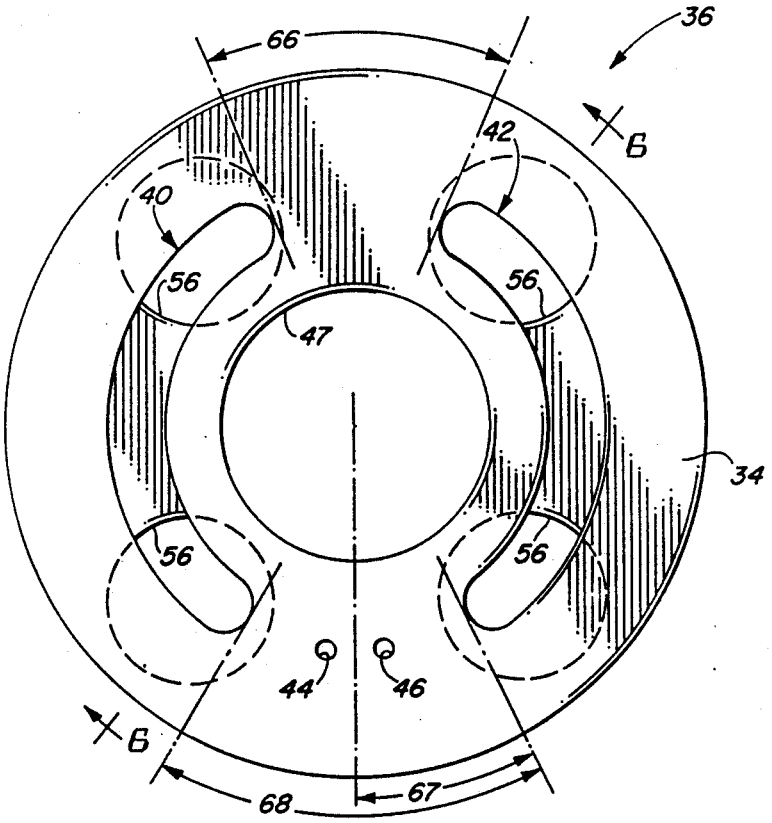
FIG. 5 is an elevational view of the port plate shown in FIG. 1 as viewed in the direction indicated by line 3—3 therein.
Figure 6:
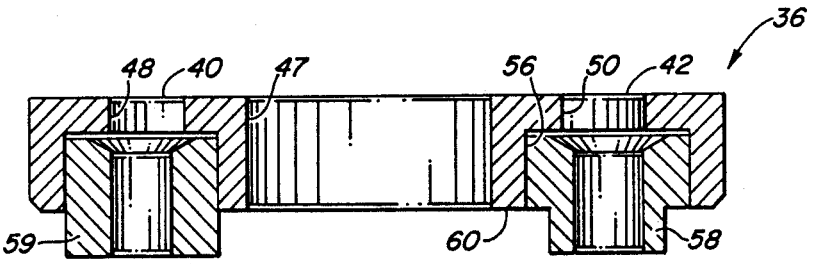
FIG. 6 is a cross-sectional view of the port plate 5 of FIG. 5 taken along line 6—6 thereof.

Referring now to FIGS. 2, 5, and 6 the port plate 36 defines two arcuate intake and discharge channels 48,50 and two additional channels 52,54 extending from the first surface 34 into the plate. The first surface 34 thus defines two arcuate ports 40,42 and two fluid exchange ports 44,46. The arcuate ports 40,42 are spaced from each other over two angular ranges 66,68 and the fluid exchange ports 44,46 are positioned in one range as illustrated.

Figure 3:
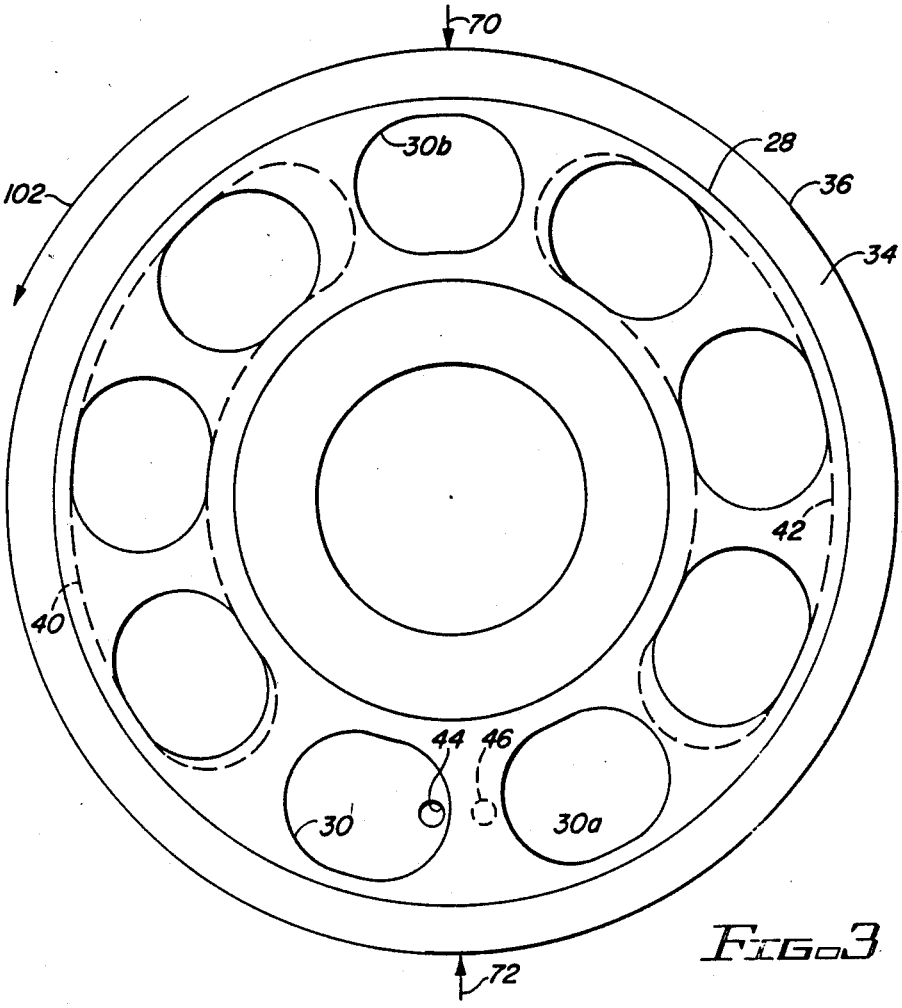
FIG. 3 is a cross-sectional view (without crosshatching) of the rotor superimposed on an elevational view of the port plate, both taken along line 3—3 of FIG. 1.
Figure 4A:
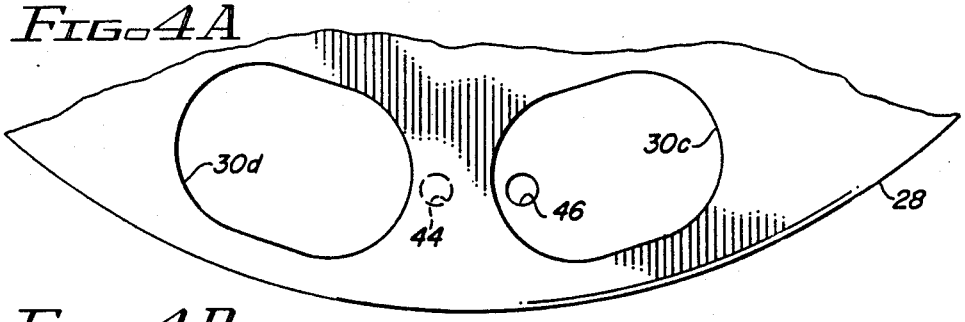
FIGS. 4 (*a–e*) are partial views similar to that of FIG. 3 and are provided to illustrate fluid communication between adjacent cylinder ports of the rotor and fluid exchange ports of the port plate in accordance with the preferred embodiment of the invention.
Figure 4B:
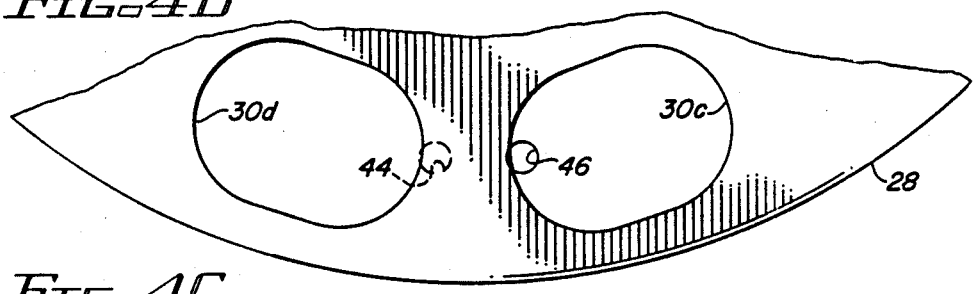
Figure 4C:
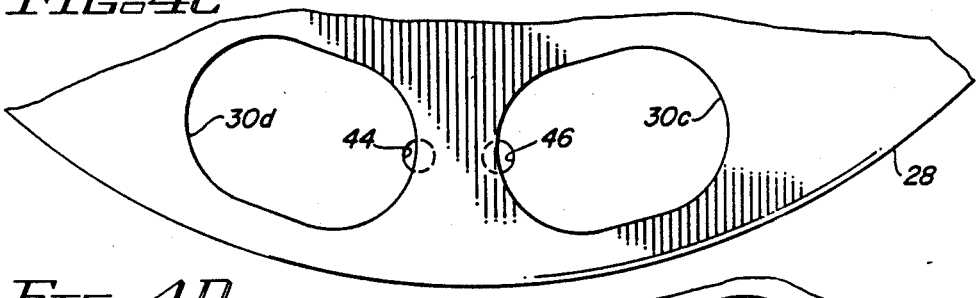
Figure 4D:
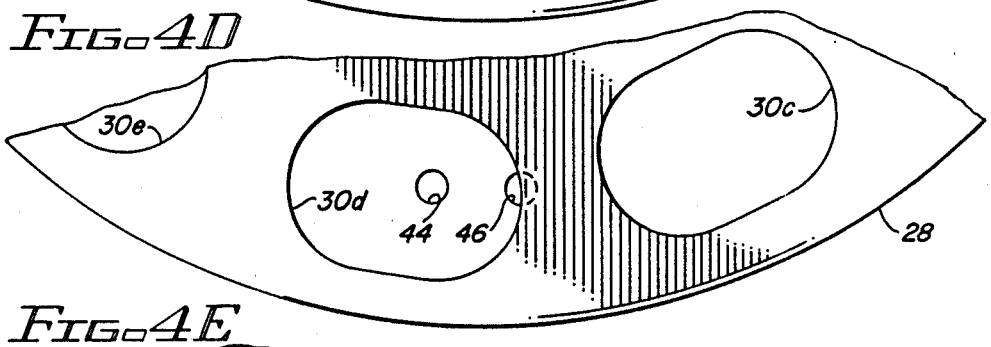
Figure 4E:
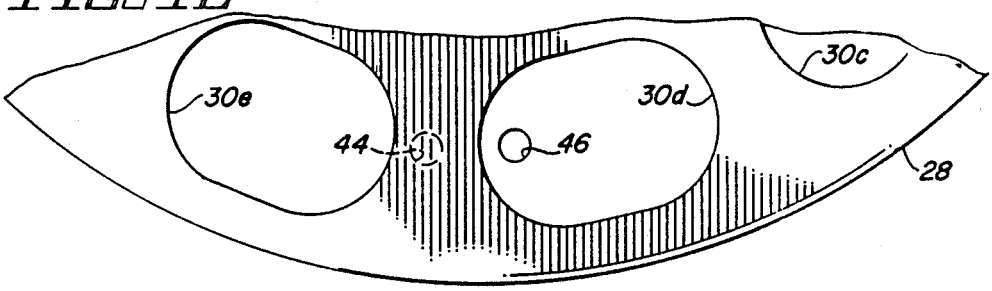

Referring to FIGS. 3 and 5, the port plate 36 is adapted with respect to the rotor 10 such that the cylinder ports 30 successively register with the arcuate ports 40,42 and the fluid exchange ports 44,46 as the rotor rotates. The angular range 68 is sufficiently large and the fluid exchange ports 44,46 are appropriately positioned to ensure that when two adjacent cylinder ports 30 are both positioned in this range, neither simultaneously registers with an arcuate port and a fluid exchange port. However, the angular range between the fluid exchange port 46 and the arcuate port 42 is only slightly greater than the angular range subtended by a cylinder port 30. The arcuate ports 40,42 are configured with respect to the cylinder ports 30 of the rotor 10 so that as each cylinder port, such as that indicated at 30*a*, begins to register with the arcuate discharge port 42, another cylinder port, such as that indicated at 30*b*, begins to register with the arcuate intake port 40. Accordingly, in the illustrated embodiments, there are always four highpressure cylinders and five low-pressure cylinders during operation of the pump 8.

Referring again to FIGS. 1, 5, and 6, the port plate 36 is preferably of the floating type in which, during operation of the pump 8, the plate is urged against the land 19 in response to fluid pressure. The plate 36 further defines four cylindrical bores (as at 56). The cylindrical bores receive conventional hollow balance pistons (as at 58) on the high-pressure side and transfer tubes (as at 59) on the low-pressure side, or receive balance pistons on both sides when the apparatus 8 is operated as a bidirectional motor. The port plate 36 further defines two smaller bores (not shown) which receive springs (not shown) used in a conventional manner to urge the plate toward the rotor 10 during start-up. The cylindrical bores 56 extend into the port plate 36 from a second surface 60 thereof which faces away from the rotor 10, and meet the arcuate channels 48,50 so that fluid communication is provided through the balance pistons 58 and transfer tubes 59 between a low pressure fluid intake channel 62 and the respective arcuate intake port 40, and between a high-pressure fluid discharge channel 64 and the arcuate discharge port 42. The balance pistons 58 and transfer tubes 59 are seated in bores (not shown) formed in the encasement 76 and the port plate is thus prevented from rotating.

Referring now to FIGS. 1 and 2, the port plate 36 defines a bore 74 extending from the second surface 60 into the plate to meet the additional channels 52,54. The encasement 76 of the pump 8 defines two stepped bores 78,80. A sleeve 81 is tightly fitted within a larger-diameter portion of the stepped bore 80. Received within the sleeve 81 are first and second springs 82,84 and a piston 86. The sleeve 81 is threaded at one end for engagement with a threaded ram 93 which adjustably extends into the sleeve 81 to preload the springs 82,84. The first spring 82 occupies a first variable-volume chamber 88 defined by the piston 86 and a portion of the sleeve 81. The second spring 84 occupies a second variable-volume-chamber 90 defined by the sleeve 81, the piston 86, and the threaded ram 93. Leakage from the chamber 90 is prevented by a seal 95 surrounding the ram 93. Received within bore 74 and bore 78 is a tube 94 fitted with seals 96,98. Unoccupied volume in the additional channels 52,54, the encasement 76, and the bores 74,78,80 is flooded with fluid. The second chamber 90 is in communication with encasement fluid via an opening 101 in the sleeve 81 that is aligned with a third bore 100 in the encasement 76.

Referring now to FIGS. 1 and 3, the port plate 36 is positioned with respect to the rotor 10 such that each cylinder port 30 is centered at rotational position 72 when its associated piston is at the bottom-dead-center position (i.e., when the piston is fully retracted). Accordingly, each cylinder port 30 is centered at rotational position 70 when its associated piston is at the top-dead-center position (i.e., when the piston is fully extended). The precompression zone is defined by an angular range 67 (FIG. 5) extending from position 72 to arcuate port 42.

Details of fluid communication between the fluid exchange ports 40,42 and the cylinder ports 30 are best understood by reference to FIG. 4. As illustrated in FIG. 4(*b*), a leading cylinder port 30*c* is still in registration with the second fluid exchange port 46 as an adjacent, trailing cylinder port 30*d* begins to register with the first fluid exchange port 44. Preferably, the geometry is such that the cylinder port 30*c* is beginning to decrease its registration with the second fluid exchange port 46 as the cylinder port 30*d* is beginning to register with the first fluid exchange port 44. Referring collectively to FIGS. 2 and 4(*a*), it can be seen that one cylinder port 30*c* has passed rotational position 72 and is in registration with the second exchange port 46 while the rotationally succeeding cylinder port 30*d* has not yet registered with the first exchange port 44. During such time (or when the cylinder port 30*c* is registered with both exchange ports and has passed position 72), the piston in the cylinder associated with cylinder port 30*c* is causing a volume of fluid to be discharged through the second exchange port 46, and the first variable-volume chamber 88 is expanding in response to the corresponding volume of fluid being received therein as piston 86 moves toward the second variable-volume chamber 90. Later, adjacent cylinder ports 30*c*,30*d* are in registration with exchange ports 46,44, respectively, as shown in FIG. 4(*c*). During such time, the first chamber 88 is substantially constant in volume as fluid is still being discharged from the cylinder associated with cylinder port 30*c* through the second exchange port 46, while an equivalent volume of fluid is being discharged through the first exchange port 44 and into the cylinder associated with cylinder port 30*d*. Later, cylinder port 30*d* is in registration with the first exchange port 44 and cylinder port 30*c* has departed from registration with the second exchange port 46 or, as shown in FIG. 4(*d*), cylinder port 30*d* is in registration with both exchange ports 44,46 but is not yet centered at rotational position 72. During such time, the piston 86 moves to contract the first chamber 88 in response to the additional spring force resulting from expansion of the first chamber 88 during the period illustrated by FIG. 4(*a*), and fluid is being discharged through either both exchange ports 44,46 or the first exchange port into the cylinder associated with cylinder port 30*d*. FIG. 4(*e*) illustrates repetition of the cycle as cylinder port 30*d* has passed rotational position 72 and is situated similarly to cylinder port 30*c* in FIG. 4(*a*).

The spring/piston arrangement of FIG. 2 should be selected to avoid frequencies at which resonance occurs, given the range of speeds over which the pump 8 is to be operated. The arrangement should also be sized to provide for exchange of the required volume of fluid without a large pressure build up. This volume may be adjusted by extending or retracting the ram 93 to change the preload on the springs 82,84.

It should be clear from the above that the invention solves a long-standing problem in the design of hydraulic axial piston motors and pumps. The cavitation that would otherwise result from the use of arcuate ports covering a limited angular range is prevented by providing means for adding fluid to each cylinder after it has departed from registration with an arcuate port of the port plate during the decompression stroke of its associated piston. This approach in solving the cavitation problem enables the use of a port plate in which the arcuate ports subtend the more limited angular range needed to provide a constant number of high-pressure cylinders in pumps or motors which are designed to operate with an odd-numbered plurality of cylinders. Moreover, since each cylinder port is permitted to depressurize in discharging a small volume of fluid through the second fluid exchange port 46, and since each will register with arcuate port 42 almost immediately after having departed from registration with the second exchange port, excessive pressurization of the cylinders is prevented.

Those skilled in the art of piston motors and pumps will recognize that the described piston/spring combination is only one of a number of means for urging fluid into each cylinder during the decompression stroke of its associated piston. Functionally equivalent arrangements could employ any known form of what is essentially a hydraulic capacitance chamber. Such arrangements could employ bellows or diaphragms, for example. It should be equally clear that the positioning of the urging means in bores formed in the encasement 76 is not limiting, since it is the particular manner by which the cavitation problem is solved, rather than the manner by which the solution taught herein is incorporated in the design of the pump or motor, which characterizes that aspect of the invention. Furthermore, although two fluid exchange ports 44,46 are indicated in the preferred embodiment of the invention, a single fluid exchange port elongated sufficiently to permit simultaneous registration with two adjacent cylinder ports can be used in accordance with the teaching contained herein, and is considered within the scope of this invention. Accordingly, the invention is limited only by the following claims and their equivalents.

I claim:

1. A hydraulic piston motor or pump having a housing in which the following elements are contained, said motor or pump comprising:

a rotatable member defining an odd-numbered plurality of cylinders in each of which is disposed an associated piston, said member having a surface defining an annularly arranged plurality of uniformly spaced cylinder ports, each cylinder port being associated with one of said pistons and cylinders and being in fluid communication therewith;

means operable with said member for causing said pistons to move in reciprocating fashion in said cylinders, said movement corresponding to compression and decompression strokes of said pistons;

a cylindrical port plate coaxial with said rotatable member and adapted for fluid communication therewith, said port plate defining a first flat surface facing said surface of said rotatable member and a second flat surface facing away from said member, said first surface defining two arcuate, circumferentially extending ports separated over two angular ranges and at least one fluid exchange port positioned in one of said angular ranges, said port plate being adapted with respect to said rotatable member such that said cylinder ports successively register with said arcuate ports and said at least one fluid exchange port as said member rotates, such that at substantially the same time as one cylinder port begins to register with one arcuate port during the decompression stroke of its associated piston, another cylinder port begins to register with the other of said arcuate ports during the compression stroke of its associated piston, and such that said at least one fluid exchange port is separated from said arcuate ports by distances ensuring that none of said cylinder ports simultaneously registers with an arcuate port and said at least one fluid exchange port, said port plate being positioned with respect to said member such that each cylinder port registers with said at least one fluid exchange port after it departs from registration with said one arcuate port but before its associated piston completes its decompression stroke.

2. A motor or pump as in claim 1 wherein said first surface defines two fluid exchange ports positioned in said angular range so that as one of said cylinder ports begins to register with a first of said fluid exchange ports, a rotationally preceding cylinder port begins to decrease its registration with a second of said fluid exchange ports.

3. A motor or pump as in claim 2 further comprising means in fluid communication with said fluid exchange ports for urging fluid into each cylinder during said decompression stroke after its associated cylinder port has departed from registration with said one arcuate port.

4. A motor or pump as in claim 3 wherein said urging means is operable to urge fluid into each cylinder through said first fluid exchange port in response to fluid discharged from said rotationally preceding cylinder through said second fluid exchange port.

5. A motor or pump as in claim 4 wherein said urging means is operable to receive fluid from each cylinder after the associated piston has completed its decompression stroke but before a rotationally succeeding cylinder has registered with said first fluid exchange port.

6. A motor or pump as in claim 5 wherein said urging means is operable to urge fluid into each cylinder through said first fluid exchange port after said rotationally preceding cylinder has departed from registration with said second fluid exchange port.

7. A motor or pump as in claim 6 wherein said port plate is a floating-type port plate said first surface of which is urged against said rotor by fluid pressure during operation of said pump or motor.

8. A motor or pump as in claim 7 wherein said port plate further defines a first bore extending from said second surface into said port plate to meet bores corresponding to said exchange ports, and wherein said housing defines an opposing bore aligned with said first bore, said bores serving to provide a fluid communication path between said exchange ports and said urging means, and further comprising means received within said first and opposing bores for providing said communication path without interruption by said film of fluid.

9. A motor or pump as in claim 6 wherein said urging means comprises a piston and two springs.

10. A motor or pump as in claim 9 further comprising means for adjustably preloading said urging means.

11. A hydraulic piston motor or pump that comprises: a rotor defining an odd-numbered plurality of axially extending cylinders in each of which is disposed an associated piston, said rotor having a surface defining an annularly arranged plurality of uniformly spaced cylinder ports, each cylinder port being associated with one of said pistons and cylinders and being in fluid communication therewith;

means operable with said rotor for causing said pistons to move in reciprocating fashion in said cylinders, said movement corresponding to compression and decompression strokes of said pistons;

a port plate defining a flat surface facing said surface of said rotor, said flat surface defining two arcuate ports spaced from each other over two angular ranges and at least one fluid exchange port positioned in one of said angular ranges, said port plate being adapted for fluid communication with said rotor such that said cylinder ports successively register with said arcuate ports and said at least one exchange port as said rotor rotates, such that at substantially the same time as each of said cylinder ports begins to register with one of said arcuate ports during the decompression stroke of its associated piston another of said cylinder ports begins to register with the other of said arcuate ports during the compression stroke of its associated piston, and such that said at least one exchange port is separated from said arcuate ports by distances ensuring that none of said cylinder ports simultaneously registers with an arcuate port and said at least one exchange port, said port plate being positioned with respect to said rotor such that each of said cylinder ports registers with said at least one exchange port after it departs from registration with said one arcuate port but before its associated piston completes its decompression stroke.

12. A motor or pump as in claim 11 wherein said flat surface defines two fluid exchange ports positioned in said one angular range so that as each of said cylinder ports begins to register with a first of said fluid exchange ports, a rotationally preceding cylinder port begins to decrease its registration with a second of said fluid exchange ports.

13. A motor or pump as in claim 11 further comprising means in fluid communication with said at least one exchange port for urging fluid into each of said cylinders during said decompression stroke after its associated cylinder port has departed from registration with said one arcuate port but before its associated piston has completed its decompression stroke.

14. A motor or pump as in claim 13 wherein said urging means comprises a piston and two springs.

15. A motor or pump as in claim 13 wherein said port plate is further adapted with respect to said rotor such that adjacent, rotationally succeeding and rotationally preceding cylinder ports simultaneously register with said at least one exchange port over an interval of time during which the piston associated with said succeeding cylinder port has not completed its decompression stroke and the piston associated with said preceding cylinder port has begun its compression stroke.

16. A motor or pump as in claim 15 wherein said urging means is operable to receive a volume of fluid through said at least one exchange port from the cylinder associated with said rotationally preceding cylinder port and to urge an equivalent volume of fluid through said at least one exchange port into the cylinder associated with said succeeding cylinder port.

17. A motor or pump as in claim 16 wherein said urging means comprises a piston and two springs.

18. A motor or pump as in claim 17 further comprising means for adjustably preloading said urging means to control said volume of fluid.

19. A hydraulic piston motor or pump that comprises: a generally cylindrical rotatable member defining an odd-numbered plurality of axially extending cylinders in each of which is disposed an associated piston, said member having a surface defining an annularly arranged plurality of cylinder ports of uniform circumferential spacing, each cylinder port being associated with one of said pistons and cylinders and being in fluid communication therewith:

means operable with said member for causing said pistons to move in reciprocating fashion in said cylinders, said movement corresponding to compression and decompression strokes of said pistons;

a non-rotating port plate adapted for fluid communication with said rotatable member, said port plate defining a first flat surface facing said surface of said rotatable member and a second surface facing away from said rotatable member, said first surface defining two arcuate ports spaced from each other over two angular ranges, said first surface further defining at least one fluid exchange port positioned in one of said angular ranges, said port plate being adapted with respect to said rotatable member such that said cylinder ports successively register with said arcuate ports and said at least one fluid exchange port as said members rotates, such that at substantially the same time as one cylinder port begins to register with one of said arcuate ports during the decompression stroke of its associated piston, another of said cylinder ports begins to register with the other of said arcuate ports during the compression stroke of its associated piston, and such that said at least one fluid exchange port is separated from said arcuate ports by distances ensuring that none of said cylinder ports simultaneously registers with an arcuate port and said at least one fluid exchange port, said port plate being positioned with respect to said member such that each cylinder port registers with said at least one fluid exchange port after it departs from registration with said one arcuate port but before its associated piston completes its decompression stroke.

20. A motor or pump as in claim 19 wherein said first flat surface defines two fluid exchange ports positioned in said one angular range so that as each of said cylinder ports begins to register with a first of said fluid exchange ports, a rotationally preceding cylinder ports beings to decrease its registration with a second of said fluid exchange ports.

21. A motor or pump as in claim 19 further comprising means in fluid communication with said at least one fluid exchange port for urging a volume of fluid into each cylinder during the decompression stroke of its associated piston.

22. A motor or pump as in claim 19 wherein said urging means comprises a piston and two springs.

23. A motor or pump as in claim 22 further comprising means for adjustably preloading said urging means to control said volume of fluid.

24. A motor or pump as in claim 21 wherein said urging means is adapted to urge said fluid into each cylinder in response to fluid discharged from a rotationally preceding cylinder.

25. A motor or pump as in claim 24 wherein said urging means is operable to receive fluid from each cylinder when the associated piston has completed its decompression stroke and the associated cylinder port is the only cylinder port in registration with said at least one fluid exchange port.

26. A motor or pump as in claim 25 wherein said urging means is operable to urge fluid into each cylinder when the associated piston has not yet completed its decompression stroke and the associated cylinder port is the only cylinder port in registration with said at least one fluid exchange port.

27. A motor or pump as in claim 26 wherein said port plate is adapted with respect to said rotatable member such that for any two adjacent cylinder ports, one of which rotationally succeeds the other, said succeeding cylinder port begins to register with said at least one fluid exchange port prior to the time at which said preceding cylinder port departs from registration with said at least one fluid exchange port.

28. A motor or pump as in claim 27 wherein said first surface defines first and second fluid exchange ports positioned in said angular range, and wherein said port plate is further adapted with respect to said member such that said preceding cylinder port begins to decrease its registration with said second exchange port as said succeeding cylinder port begins to register with said first exchange port.

29. A motor or pump as in claim 28 wherein said urging means comprises a piston and two springs.

* * * * *